United States Patent [19]

Taylor

[11] Patent Number: 4,693,315

[45] Date of Patent: Sep. 15, 1987

[54] BLEEDOFF TOOL FOR WELL TEST SYSTEM

[75] Inventor: Frank H. Taylor, Carrollton, Tex.

[73] Assignee: Otis Engineering Corporation, Dallas, Tex.

[21] Appl. No.: 904,694

[22] Filed: Sep. 8, 1986

Related U.S. Application Data

[62] Division of Ser. No. 764,391, Aug. 12, 1985, Pat. No. 4,640,363.

[51] Int. Cl.[4] ..... E21B 34/04

[52] U.S. Cl. ..... 166/336; 166/340

[58] Field of Search ..... 166/317, 330, 336, 338, 166/363, 373, 386, 340, 345, 344, 364, 365,

[56] References Cited

U.S. PATENT DOCUMENTS

| | | | |
|---|---|---|---|
| 3,451,475 | 6/1969 | Price | 166/336 |
| 3,823,773 | 7/1974 | Nutter | 166/336 |
| 4,234,043 | 11/1980 | Roberts | 166/336 |
| 4,253,525 | 3/1981 | Young | 166/321 |
| 4,286,661 | 9/1981 | Gazda | 166/316 |
| 4,522,370 | 6/1985 | Noack et al. | 166/324 |

*Primary Examiner*—Stephen J. Novosad
*Assistant Examiner*—Terry Lee Melius
*Attorney, Agent, or Firm*—Roland O. Cox

[57] ABSTRACT

Disclosed is a safety system for well testing, utilizing a new and novel bleedoff tool in the subsea test tree handling string, which provides rapid pressure reduction in the handling string and assures mechanical disconnect of the subsea test tree if the test tree cannot be disconnected hydraulically. The bleedoff tool is operated and opened to bleed pressure from the handling string by applying a predetermined torque. This tool may be extended by pull to transmit higher than opening torque and will transmit torque after opening. The bleedoff tool contains an internal valve, which closes when the bleedoff tool is opened, and retains fluids in the handling string. The bleedoff tool operating torque values are not changed by high internal pressures or great axial tension or compressive loads on the tool.

10 Claims, 6 Drawing Figures

BLEEDOFF TOOL FOR WELL TEST SYSTEM

This application is a division of my copending U.S. application for patent, Ser. No. 764,391, filed Aug. 12, 1985 now U.S. Pat. No. 4,640,363.

BACKGROUND OF THE INVENTION

This invention relates to systems and apparatus used in conducting production tests of underwater wells from floating vessels and specifically relates to a more reliable system utilizing a new and novel bleedoff tool in the test string.

During production testing of underwater wells located in deep water, using a test system which includes a test tree similar to the TEST TREE of U.S. Pat. No. 4,494,609 to Schwendemann, pressure in the test string may become so high as to induce high axial tensile forces in the test tree and cause friction seizure of the test tree disconnect members and prevent mechanical disconnect of the test tree, with possibly disastrous results.

SUMMARY OF THE INVENTION

The subsea test tree is normally unlatched for disconnect by remotely applying hydraulic pressure through selected control lines. In the event disconnect cannot be accomplished hydraulically, a quick disconnect for emergency situations may by made by applying torque to the handling string on the drill ship, to rotate the latch section of the tree and mechanically disconnect from the test tree body, which is held against rotation by blowout preventer rams closed on the test string below the test tree.

If during test operation, the test tree body valve is closed and the handling string retainer valve is closed, well pressure from the test string will be trapped between these valves and will induce an axial tensile load on the subsea test tree which increases friction between threaded disconnect members in the test tree. If the internal tree pressure is high enough, the disconnect members in the tree latch are friction seized and locked and rotation and mechanical disconnect cannot occur. Hydraulic disconnect cannot occur even if control lines are intact because they cannot withstand the high pressure required to overcome the friction between the disconnect members. If no disconnect can be made even in an embergency situation, severe disaster may result.

A bleedoff tool of the present invention, installed between the subsea test tree and retainer valve in the handling string, may be operated by turning the handling string, to bleed and reduce the trapped high pressure directly into the riser or control lines around the retainer valve and into the handling string above. As the lower piston end of the bleedoff tool and test tree latch section cannot rotate, torque applied to the upper body end of the tool will turn the body on the piston and shear pins to open a flow passage from inside to outside the tool. Reduction of the trapped pressure will permit rotation of the tree latch section for quick mechanical disconnect and disaster will be prevented.

During well test operations, if control line integrity is lost, the retainer valve in the handling string cannot be operated to prevent all fluids in the handing string from being dumped into the riser or surrounding water as the subsea test tree is disconnected. The bleedoff tool is provided with an internal valve which closes automatically when the tool is operated to retain fluids above in the handling string. This closed vlave isolates a smaller volume of trapped fluids in the handling string, which may be bled rapidly through the bleedoff tool, providing more rapid pressure reduction and subsea test tree disconnect. Also, the smaller isolated volume will impart a much smaller upthrust or "launching" force to the handling string on disconnect of the subsea test tree.

If there is a need to rotate the handling and test strings together before operating the bleedoff tool, pull may be applied to the handling string to engage friction surfaces in the bleedoff tool and torque may now be transmitted through the tool without loading operating shear pins.

The bleedoff tool is additionally provided with a liquid filled chamber which serves as a liquid bearing providing free rotation between the bleedoff tool body and piston.

Also, the bleedoff tool of this invention is provided with equal sealed areas having a balancing effect which prevents high internal pressures from moving the piston out of the body to engage stop shoulder friction surfaces and prevent free relative rotation of the body around the piston.

One object of this invention is to provide a more reliable deep water production well testing system for underwater wells.

Another object of this invention is to provide a handling string for a well test system in which pressure may be rapidly reduced to assure quick mechanical disconnect of the subsea test tree.

Another object is to provide a bleedoff tool for a test tree handling string, which is operable by predetermined torque and may be selectively operated to transmit greater than operating torque and will continue to transmit torque after operation.

Another object is to provide a bleedoff tool having a predetermined operating torque which is not changed by axial tension or compressive loads applied to the tool or high pressure therein.

Another object of this invention is to provide a bleedoff tool having a valve therein, which automatically closes during operation and prevents down flow through the tool.

DESCRIPTION OF THE PREFERRED EMBODIMENT

Figure 1A:
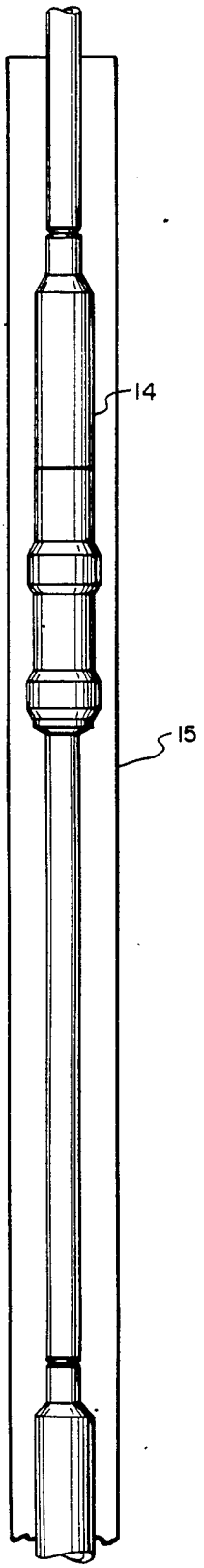
FIG. 1 (A, B and C) is a schematic drawing showing the upper portion of a test string in a riser while testing a well.
Figure 1B:
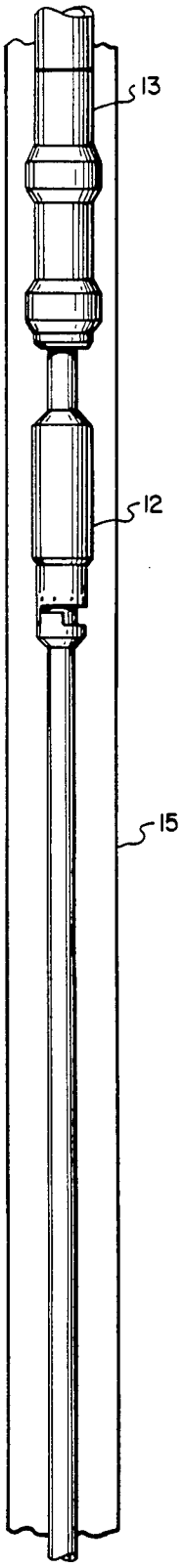
Figure 1C:
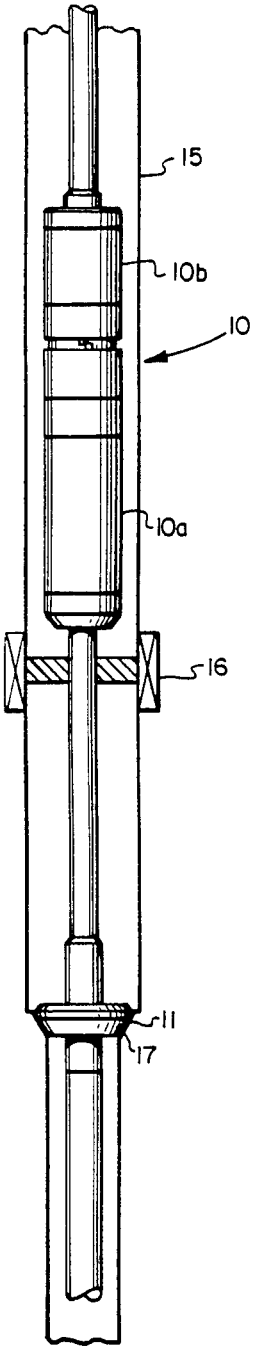

FIG. 1, shows a subsea test tree 10 having a body portion 10*a* and a latch portion 10*b*. The test tree is made up in the upper portion of a pipe string, which is useful in the well testing and the system of this invention. The upper portion of the test string includes a hanger 11, a bleedoff tool 12 of this invention and a retainer valve 13. A lubricator valve 14 may also be included if desired or the VALVE of U.S. Pat. No. 4,522,370 to Noack and Rathie, which functions as both a lubricator valve and a retainer valve. The entire well test string is made up and run from a floating vessel through riser 15 and open blowout preventer 16 into the well, until hanger 11 lands on an internal shoulder 17 in the underwater well head. Routine well testing operations may now be conducted and the subsea test latch quickly disconnected from the body, if required, by first closing blowout preventer 16 on pipe below the test tree to prevent the test tree body from rotating and rotating the upper handling string portion of the pipe string and tools therein above the test tree.

If during testing operations, using the system of this invention, a quick disconnect of the test tree is required and the handling string and test tree latch portion cannot be released hydraulically nor rotated out of the body portion because of high pressure trapped between the closed retainer and subsea test tree valves in the handling string, the bleedoff tool of this invention may be operated to reduce the pressure.

Figure 2A:
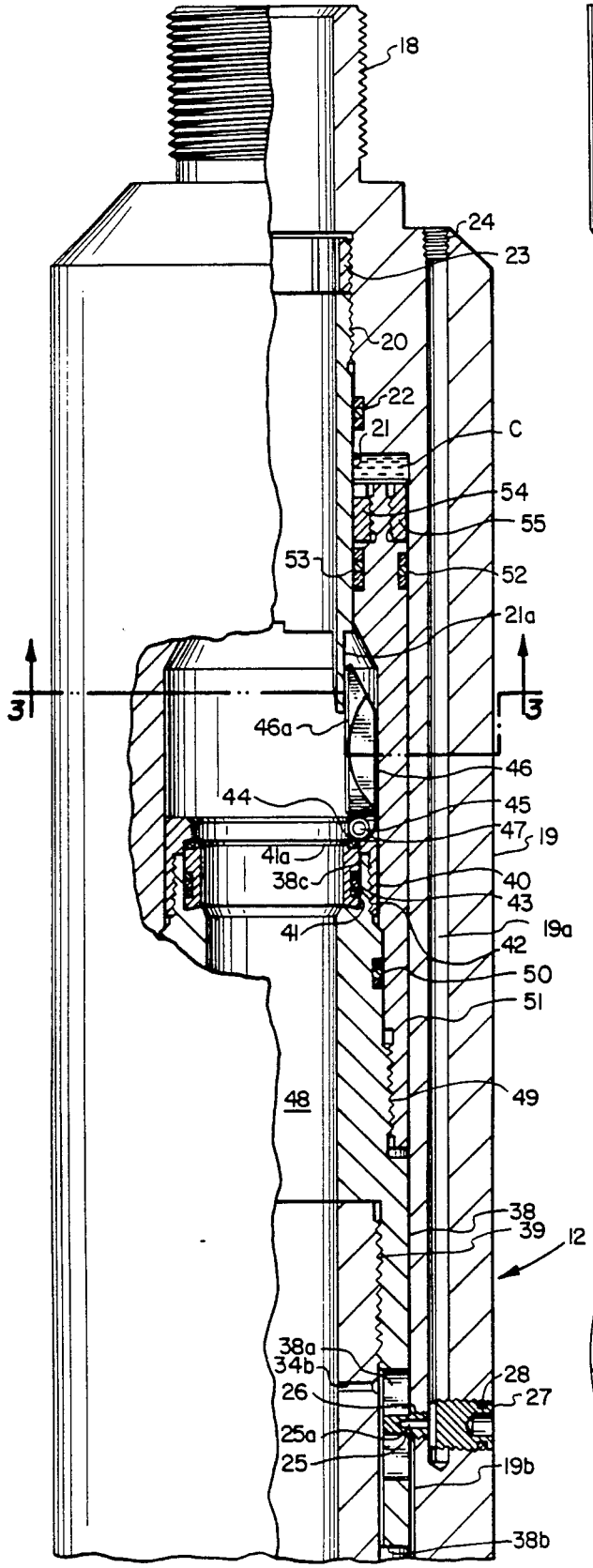
FIG. 2 (A and B) is a half section elevation view drawing of the bleedoff tool of this invention.
Figure 2B:
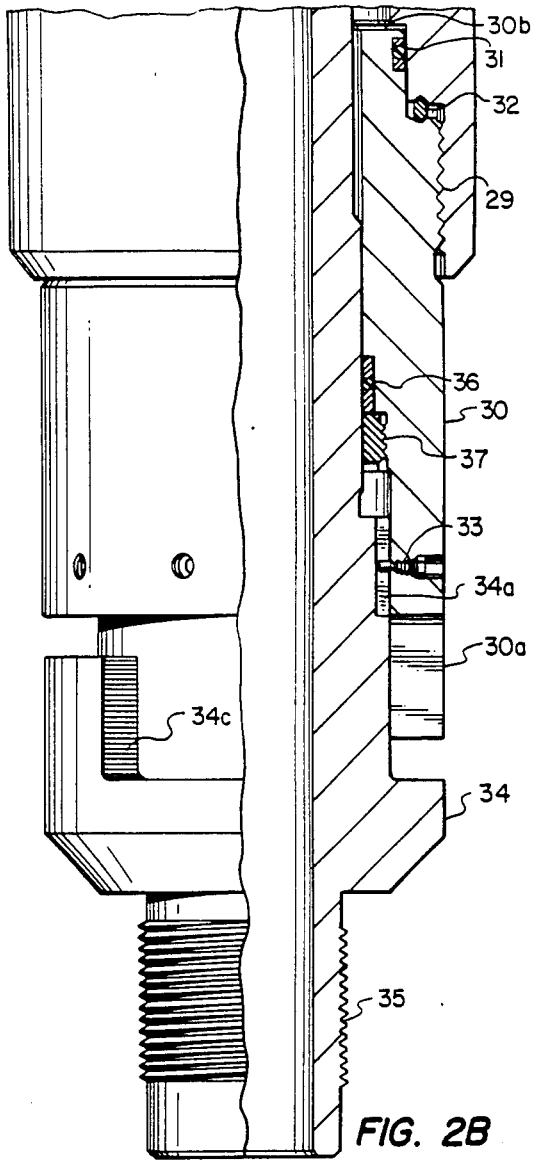
Figure 3:
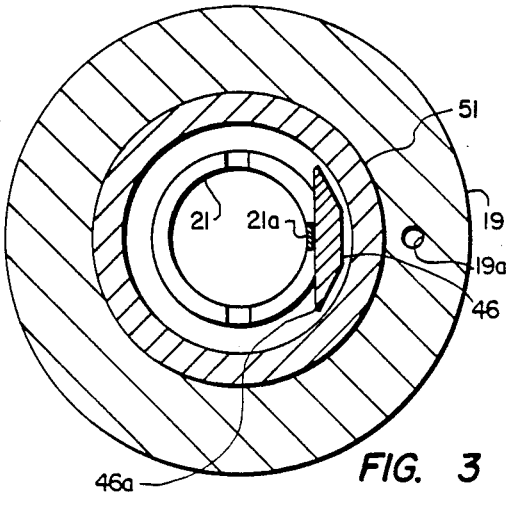
FIG. 3 is a cross section view along line 3—3 of FIG. 2.

The bleedoff tool 12 of this invention, in the preferred form is shown in FIG. 2, and has an appropriate thread 18 on upper body 19 for connection in the handling string. Connected in the upper body by threads 20 is a flapper prop 21, sealed to the upper body by resilient seal 22. The flapper prop is positioned in the body by jam nut 23. The upper body has a flow passage 19*a* to conduct trapped well fluid to a conduit (not shown) connected at threads 24 from shear open plug 25 which has flow passage 25*a*. The plug has been installed in sealing threads 26 cut through the wall between flow passage 19*a* and bore 19*b* in upper body 19. A plug 27 threaded into the body wall, closes the hole through which sealing threads 26 were cut. Resulient seal 28 seals plug 27 in the upper body. Connected to the upper body with threads 29 is a lower body 30. A resilient seal 31 seals the lower and upper bodies together. A second seal, metal ring 32 is compressed between the upper and lower bodies, sealing therebetween.

The lower body has a donwwardly extending lug 30*a*, a friction surface 30*b* and a number of shearable screws 33 are threadedly connected in the lower body wall and each protrudes into one of the slots 34*a* in lower mandrel 34. The lower mandrel has an appropriate thread 35 for connection into the well test string, a wall opening 34*b*, a lug 34*c* and is swivelably sealed in the lower body by resilient seal 36, which is positioned by retainer 37. The lower mandrel is connected to flapper mandrel 38 with threads 39. The flapper mandrel has a slot 38*a*, into which shear open plug 25 protrudes and a friction surface 38*b*. Retained in bore 38*c* on the upper end of the flapper mandrel by flapper housing 40 is a flapper seat 41. The flapper housing is connected to the mandrel by thread 42 and the flapper seat is sealed to the mandrel with resilient seal 43. There is a groove cut in the upper end of the flapper seat in which a resilient seal 44 is installed and a sealing surface 41*a* has been formed on the flapper seat. A pin 45 pivotally attaches a flapper valve 46, having a sealing surface 46*a*, to the flapper seat. A spring 47 is positioned around the pin, biasing the flapper valve toward closed position where sealing surface 46*a* sealingly engages sealing surface 41*a* and resilient seal 44, closing longitudinal flow passage 48 to downflow only.

FIG. 2 shows the flapper prop 21 positioned radially by plug 25 and pin 33 so the prop extension 21*a* prevents spring 47 from moving the flapper valve to closed position.

Connected and sealed to flapper mandrel 38 by threads 49 and resilient seal 50, respectively, is an upper mandrel 51. This upper mandrel is rotatably sealed in bore 19*b* with resilient seal 52 and rotatably sealed around flapper prop 21 with resilient seal 53. These seals and their backup rings are reatined on the upper mandrel with retainers 54 and 55. A sealed chamber C is formed in upper body 19 by seals 52 and 53. There are two holes (not shown) drilled from the outside of upper body 19 to allow chamber C to be filled with a liquid, preferably light oil. The holes and chamber are sealed by installing sealing plugs (not shown) in the holes.

Relative rotation between connected bodies 19, and 30, or body portion of the bleedoff tool, and connected mandrels 34, 38 and 51, or piston portion of the bleedoff tool, is prevented by shear open plug 25 protruding into slot 38*a* and shear screws 33 protruding into slot 34*a*.

The bleedoff tool, as shown in FIG. 2, is made up in the handling string above the subsea test tree and below the retainer valve and a conduit to the handling string above the retainer valve may be connected to the bleedoff tool body by thread 24 communicating flow passage 19*a* with the interior of the handling string or if no conduit is connected, flow passage 19*a* will communicate with the riser interior.

At any time during running in or pulling the test string from a well, the full weight of the test string suspended from the bleedoff tool will pull the tool mandrels (piston) out of the tool bodies, reducing liquid pressure in chamber C and increasing the normal length of the bleedoff tool until friction surface 38*b* contacts friction surface 30*b*.

When these friction surfaces contact, torque may be transmitted through the bleedoff tool. The friction surface roughness may be increased or friction surfaces grooved to create a clutching action and increase torque transmitted by the bleedoff tool when the friction surfaces contact.

When it is necessary to operate the bleedoff tool, almost the total weight of the test string is supported by hanger 11 on internal shoulder 17 and only the weight of the handling string above the bleedoff tool is supported by the bleedoff tool. This weight loads the bleedoff tool bodies, moving friction surface 30*b* from contact with friction surface 38*b*, increasing the pressure in liquid chamber C. When the friction surfaces are not contacting, the liquid chamber acts as a liquid bearing, supporting the weight of the handling string and providing low friction rotation of the bleedoff tool bodies around the tool piston portion.

The bleedoff tool has been provided with equal balancing areas, which prevent movement of the piston to further extend from or move into the bodies when trapped pressure is in passage 48. When the retainer valve above and the test tree valve below the bleedoff tool are closed, pressure is trapped therebetween in the handling string and bleedoff tool passage 48 and a tensile load is placed on the bleedoff tool moving friction surface 30*b* into moving contact with friction surface 38*b*, preventing relative rotation of the bodies and piston and operation of the bleedoff tool. The pressure trapped in passage 48 acts on the area sealed by seal 53 and through opening 34*b* on the area sealed by seal 52 tending to force the piston into the bodies. This pressure acts simultaneously on the area sealed by seal 36, (area of passage 48 plus annular area of mandrel 34 in seal 36) and tends to force the piston from the bodies. As these sealed areas are equal by design, the bleefoff tool is pressure balanced and high pressure in passage 48 will not move the piston into or further extend it out of the bodies.

When sufficient torque is placed on the handling string above the bleedoff tool to rotate the tool bodies around the tool piston, plug 25 and pins 33 and sheared, flapper prop 21 is rotated from under flapper 46, which is moved to closed position by spring 47 and pressure trapped between the closed retainer and test tree valves and in bleedoff tool passage 48 will flow through wall opening 34*b*, now open plug flow passage 25*a*, flow passage 19*a* and into the riser annulus exterior of the tool or a connected conduit and then into the handling string above the retainer valve. The cumulative torque shear values of pins 33 and plug 25 will determine the torque necessary to shear the plug and pins for rotation of the bleedoff tool bodies around the piston. The reduction in trapped pressure has reduced tensile loading on the test tree and friction between threaded disconnect members has been reduced greatly.

Continued rotation of the tool bodies relative to the piston after shear will contact body lug 30*a* with mandrel lug 34*c*, providing for transmission of handling string torque through the bleedoff tool to the test tree latch section to rotate the tree latch portion relative to the tree body and complete the emergency disconnect procedure.

What is claimed is:

1. A safety system for testing underwater wells comprising:

(a) a riser on a blowout preventer spaced above a landing shoulder in the well casing; and (b) a string of test pipe in the well casing and riser including a retainer valve spaced above a bleedoff tool having a piston, a body rotatably mounted and sealed around said piston and closed flow passage means therein, said passage means openable by relative rotation between said piston and body to permit flow between the inside of said bleedoff tool and said riser, said bleedoff tool spaced above a subsea test tree having an upper latch section releasably connectable to a lower body and said subsea test tree spaced above a hanger near the upper end of said string.

2. The safety system of claim 1 further including a lubricator valve in the test string spaced above the retainer valve.

3. The safety system of claim 1 wherein the string of test pipe comprises:

(a) an upper section having a retainer valve spaced above the bleedoff tool, which is spaced above a subsea test tree latch suction; and (b) a lower section having a subsea test tree body spaced above a hanger near the top of said lower section, the hanger to body space in said lower pipe section being greater than the casing landing shoulder to blow out preventer space in the casing.

4. The safety system of claim 3 wherein the upper test pipe section further includes a lubricator valve spaced above the retainer valve.

5. A safety system for testing underwater wells comprising:

(a) a riser on a blowout preventer spaced above a landing shoulder in the well casing; and (b) a string of test pipe in the well casing and riser including a retainer valve spaced above a bleedoff tool having a longitudinal flow passage therethrough and including:

a piston, a body rotatably mounted, sealed around and releasably pinned to said piston, means for limiting body rotation relative to said piston to less than one turn, pressure balanced areas on the piston for preventing extension of said piston from said body, bearing means for minimizing relative rotational friction between said body and piston, closed flow passage means, openable on relative rotation between the body and piston to permit flow from the longitudinal flow passage to exterior of the tool, valve means in the longitudinal flow passage positioned open to permit two-way flow therethrough, said valve means releasable on relative rotation between the body and piston to close and permit upward flow only through said flow passage, means biasing said valve means closed, and friction means for transmitting torque through the tool, and said bleedoff tool is spaced above a subsea test tree, having an upper latch section and lower body and is spaced above a hanger, said hanger landed on said well casing shoulder.

6. The safety system of claim 5 further including a lubricator valve in the test string spaced above the retainer valve.

7. The safety system of claim 5 wherein the string of test pipe comprises:

(a) an upper section having a retainer valve spaced above the bleedoff tool, which is spaced above the subsea test tree latch section; and (b) a lower section having a subsea test tree body spaced above a hanger near the top of said lower section, the hanger to body space in said lower pipe section being greater than the casing landing shoulder to blow out preventer space in the casing.

8. The safety system of claim 7 wherein the upper test pipe section further includes a lubricator valve spaced above the retainer valve.

9. A safety system for testing underwater wells comprising:

(a) a riser on a blowout preventer spaced above a landing shoulder in the well casing; and (b) a string of test pipe in the well casing and riser including a combination lubricator-retainer valve spaced above a bleedoff tool having a piston, a body rotatably mounted and sealed around said piston and closed flow passage means therein, said passage means openable by relative rotation between said piston and body to permit flow between the inside of said bleedoff tool and said riser, said bleedoff tool spaced above a subsea test tree having an upper latch section releasably connectable to a lower body and said subsea test tree spaced above a hanger near the upper end of said string.

10. A safety system for testing underwater wells comprising:

(a) a riser on a blowout preventer spaced above a landing shoulder in the well casing; and (b) a string of test pipe in the well casing and riser including a combination lubricator-retainer valve spaced above a bleedoff tool having a longitudinal flow passage therethrough and including:

a piston, a body rotatably mounted, sealed around and releasably pinned to said piston, means for limiting body rotation relative to said piston to less than one turn, pressure balanced areas on the piston for preventing extension of said piston from said body, bearing means for minimizing relative rotational friction between said body and piston, closed flow passage means, openable on relative rotation between the body and piston to permit flow from the longitudinal flow passage to exterior of said tool, valve means in the longitudinal flow passage positioned open to permit two-way flow therethrough, said valve means releasable on relative rotation betwen the body and piston to close and permit upward flow only through said flow passage, means biasing said valve means closed, and friction means for transmitting torque through the tool, and said bleedoff tool is spaced above a subsea test tree, which is spaced above a hanger, said hanger landed on said well casing shoulder.

* * * * *